United States Patent [19]

Falkowski et al.

[11] 4,428,294

[45] Jan. 31, 1984

[54] FINLESS GUN-FIRED PRACTICE ROUND

[75] Inventors: Edmund W. Falkowski, Montague; Michael J. Kolasa, Garfield, both of N.J.

[73] Assignee: The United States of America as represented by the Secretary of the Army, Washington, D.C.

[21] Appl. No.: 408,316

[22] Filed: Aug. 16, 1982

[51] Int. Cl.[3] ..... F42B 13/20

[52] U.S. Cl. ..... 102/444; 102/439; 102/529

[58] Field of Search ..... 102/430, 444, 498, 501, 102/508, 513, 529, 431–439, 519

[56] References Cited

U.S. PATENT DOCUMENTS

| | | | |
|---|---|---|---|
| 2,776,621 | 1/1957 | Rosenblatt | 102/439 |
| 2,793,590 | 3/1953 | Brandt | 102/444 |
| 3,880,083 | 4/1975 | Wasserman et al. | 102/519 |

FOREIGN PATENT DOCUMENTS

| | | | |
|---|---|---|---|
| 1028123 | 5/1966 | United Kingdom | 102/437 |
| 1363495 | 8/1974 | United Kingdom | 102/444 |

*Primary Examiner*—Charles T. Jordan
*Assistant Examiner*—Tyrone Davis
*Attorney, Agent, or Firm*—Robert P. Gibson; Anthony T. Lane; Max Yarmovsky

[57] ABSTRACT

A finless non-spinning round is able to maintain range accuracy and reduced gun tube wear by the use of a single base cool burning propellant, an improved shape wear liner, and a warhead projectile configured to position the center of gravity of the warhead so that it is equal to or greater than 0.5 calibers forward of the warhead's aerodynamic center of pressure.

5 Claims, 2 Drawing Figures

FINLESS GUN-FIRED PRACTICE ROUND

GOVERNMENT INTEREST

The invention described herein may be manufactured, used and licensed by or for the Government for governmental purposes without the payment to us of any royalty thereon.

BACKGROUND OF THE INVENTION

1. Field of the Invention

The present invention is related to an inert training practice round used in firing tests in place of a spike-nose, cylindrical body, boattail boom-fin assembly explosive round. The present invention by structural design permits the present practice round to be fired from the same weapon as the explosive round with equivalent down-range accuracy at a substantial savings in production round cost and reduction in weapon tube wear.

2. Description of the Prior Art

Gun fired projectiles are generally either spin stabilized or fin stabilized in order to attain consistent down-range accuracy with limited shot dispersion. A fin stabilized projectile is statically and dynamically stable due to the stabilizing moment developed by either a fin, a flare or some other lift producing element. Normally, statically stable practice rounds, rather than using spin, use the stabilizing moment developed by its aerodynamic contour and its other physical characteristics. One of the problems with prior art inert practice rounds of the fin stabilized type was the size of the boattail-boom-fin assembly in the cartridge case. In this design the position of a wear liner could not be located in the best position. As a result of the non-optimal positioning of the wear liner, excessive gun tube wear was frequently encountered resulting in short gun tube life.

PRIOR ART STATEMENT

A cursory review has been made of finless practice cartridges under class 102, subclass 444, and no disclosure has been found which may be considered pertinent to the present invention.

SUMMARY OF THE INVENTION

The present invention relates to a finless stable training practice round which can reduce gun-wear by use of a slow burning propellant. This improvement is accomplished without degradation of projectile accuracy or range. The present invention includes a projectile warhead having a spiked-nose attached to a boat-tailed cylindrical body. The projectile provides acceptable flight performance of a 2000 meter target without the use of stabilizing fins. Good aero-dynamic stability is obtained by selection of projectile, materials, shape and size so that the center of gravity of the warhead is positioned equal to or greater than 0.5 calibers forward of the projectile's aerodynamic center of pressure. Optimization of the location of the wear liner and the use of slower burning propellant provides for reduced gun-tube wear.

The object of the present invention is to provide a finless stable training practice round which reduces excessive gun wear without reduction in range.

Another object of the present invention is to provide a finless stable training practice round which has low gun-tube wear while maintaining projectile accuracy out to 2000 meters.

Another object of the present invention is to provide a finless stable training practice round which is less expensive to produce.

A further object of the present invention is to provide a finless stable training practice round which will increase tube life by optimum location of wear liner and the use of a cooler burning propellant.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENT

Figure 1:
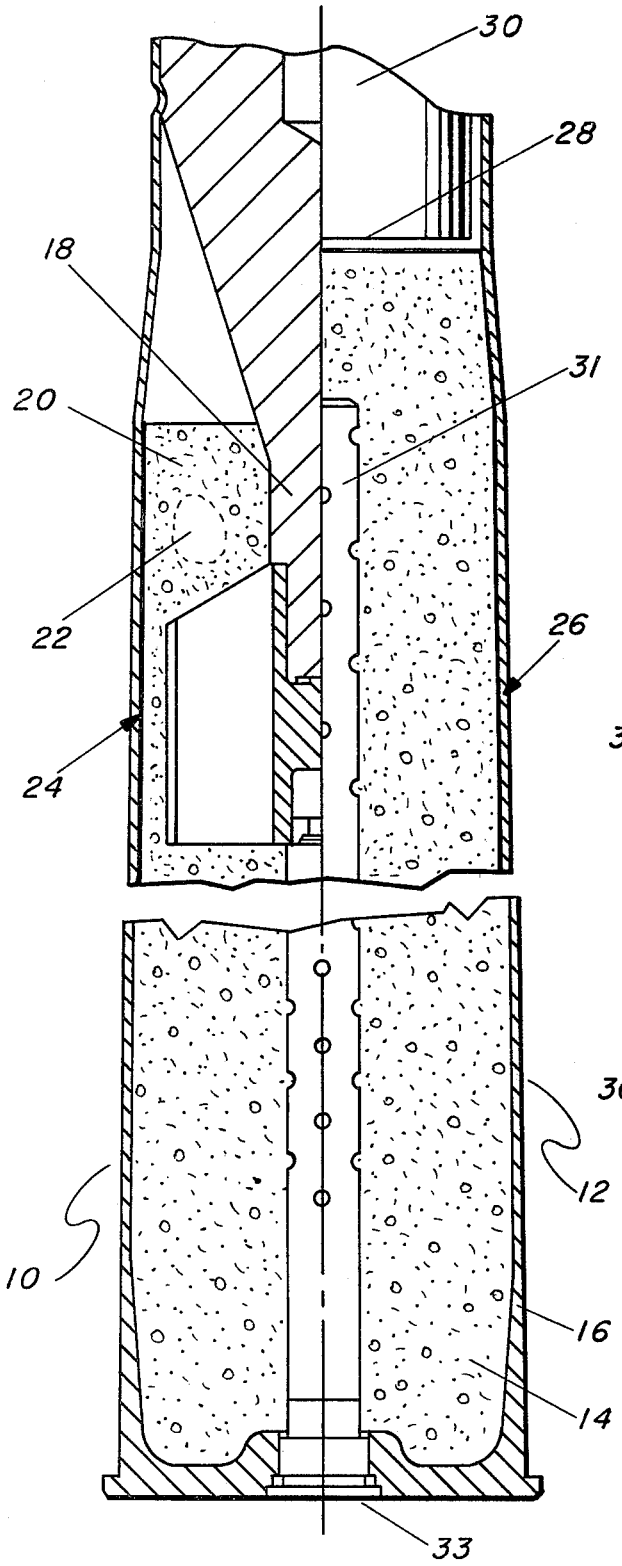
FIG. 1 is a partial cut-away diametrical cross-sectional view of the prior art on the upper half side of the longitudinal section and the present invention on the lower half side section showing the cartridge end of the training practice round.

Referring now to FIG. 1, the upper diametrical cross-sectional 10 shows a typical prior art fin stabilized training practice round. The lower section 12 shows the present invention and by comparison the difference in available space for a cooler burning single base propellant 14 contained within cartridge case 16. The boattail-boom fin assembly 18 in the prior art design protrudes into the triple-base propellant 20 in cavity 22 taking away volume in the cartridge case 16 which could otherwise be utilized for propellant. In the prior art design a short cylindrical wear liner 24, is positioned intermediate the inner wall of cartridge case 16 and the triple base propellant 20. In the present invention an extended cup shaped wear liner 26 made of such material as titanium-dioxide is disposed intermediate the inner wall of cartridge 16 and the single-base propellant 14. The warhead 30 is operatively staked to case 16 by means well known in the art. The cartridge case 16 includes a centrally positioned perforated igniter tube 31 and an impact primer 33 located in axial alignment with the igniter tube 31.

Figure 2:
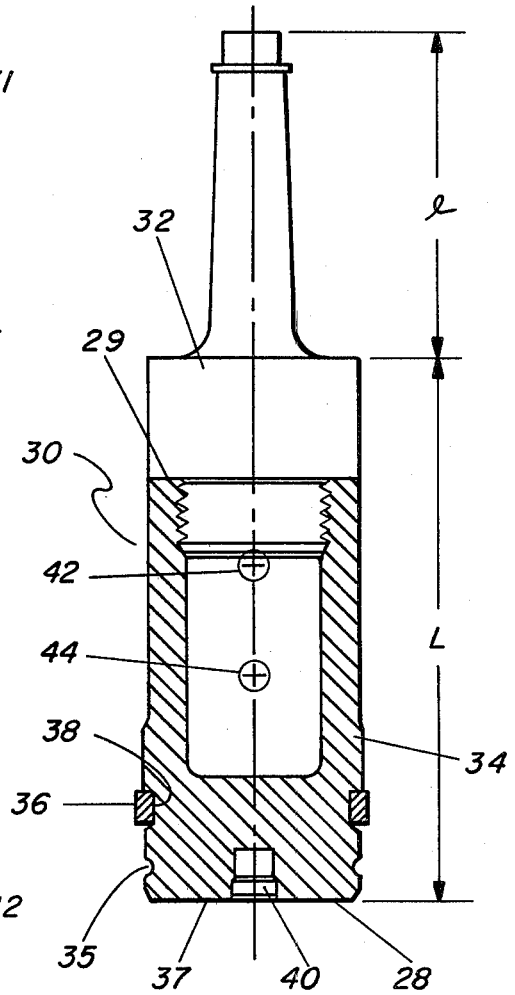
FIG. 2 is a partial cross-sectional view of the warhead projectile assembly of the present invention.

Referring now to the warhead 30 in FIG. 2, the warhead projectile 30 is manufactured in two pieces, a steel spike-nose section 32 which is threadedly attached to the open end 29 of an aluminum cylindrical-hollow after body 34. The density difference in the spike-nose 32 member over the cylindrical-hollow after body 34 is equal to or greater than 2.5 to 1. Cartridge case 16 is removably held to the warhead 30 by crimping of the cartridge wall into the warhead annular cartridge wall groove 35 by means well known in the art. An obturator slip band 36 is rotatably disposed in annular slip band groove 38 and a tracer member 40 is axially located in the closed end 37 of the after body 34. The heavy steel spike nose 32 is designed to maintain the projectile center of gravity 42 forward of the aerodynamic center of pressure 44 by a longitudinal distance equal to or greater than 0.5 calibers. The Spike section length "1" is desgned to be approximately 1.5 calibers and the combined cylindrical section of length "L" of the warhead is designed to be approximately 2.6 calibers.

The present invention with the aforementioned design parameters will provide acceptable flight performance to a 2000 meter target without the use of a stabilizing fin or a projectile requiring spin. Increased gun tube life is obtained by the combination of optimum location of wear liner 26 and the utilization of a cooler burning single-base propellant 14.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A finless gun-fired practice round which comprises:

a cartridge case;

a single base propellant operatively disposed in said cartridge case;

a centrally disposed perforated igniter for igniting said propellant;

primer means axially positioned in said cartridge case for activating said igniter;

a cylindrically shaped warhead operatively staked in said cartridge case which includes;

a cylindrically shaped hollow after body having an internally threaded open end and a closed end, an annular slip band groove, and an annular cartridge wall groove therein;

an obturator slip band operatively disposed in said slip band groove;

a spike nose member threadedly attached to said open end of said after body, said spike nose member having a difference in density over said after body equal to or greater than 2.5 to 1 and a configuration designed to maintain the warhead center of gravity forward of the warhead aerodynamic center of pressure by a longitudinal distance equal to greater than 0.5 calibers; and a cup shaped wear liner operatively disposed intermediate the inner wall of said cartridge and said single base propellant and intermediate the rear end of said after body and said single-base propellant.

2. A practice round as recited in claim 1 wherein said spike-nose member includes a spike section of length "1" and a combined cylindrical section of said after body and spike-nose member of length "L" wherein said "1" length is approximately 1.5 calibers and said "L" length is approximately 2.6 calibers.

3. A practice round as recited in claim 1 wherein said wear liner is made of titanium dioxide material.

4. A practice round as recited in claims 2 or 3 wherein said closed end of said after body includes an axially aligned tracer member fixedly disposed therein.

5. A practice round as recited in claim 4 wherein said spike nose member is made of steel and said after body is made of aluminum material.

* * * * *